US005445291A

United States Patent [19]

Daniel

[11] Patent Number: 5,445,291

[45] Date of Patent: Aug. 29, 1995

[54] PRESSURIZED PACKAGE FOR A PARTICULATE MATERIAL EMPLOYING A VENTING MEMBER

[75] Inventor: Wade K. Daniel, Cincinnati, Ohio

[73] Assignee: The Procter & Gamble Company, Cincinnati, Ohio

[21] Appl. No.: 307,553

[22] Filed: Sep. 16, 1994

Related U.S. Application Data

[63] Continuation of Ser. No. 957,570, Oct. 7, 1992, abandoned.

[51] Int. Cl.[6] ..... B65D 1/40; B65D 51/16

[52] U.S. Cl. ..... 220/366.1; 220/373; 220/374; 220/747

[58] Field of Search ..... 220/745, 366, 208, 747, 220/373, 374, 913, 698; 426/118, 131, 395, 397, 398, 404

[56] References Cited

U.S. PATENT DOCUMENTS

| | | | |
|---|---|---|---|
| 247,621 | 9/1881 | DeVoe et al. . | |
| 314,839 | 3/1885 | Hazard . | |
| 1,344,664 | 6/1920 | Wander . | |
| 1,696,240 | 12/1928 | Kircher, Jr. | 220/698 |
| 2,024,511 | 12/1935 | Darling | 220/366 X |
| 2,049,264 | 7/1936 | Karl | 426/131 |
| 2,207,210 | 7/1940 | Von Knauf | 220/698 |
| 2,268,241 | 12/1941 | Brueckel | 220/698 |
| 2,436,193 | 2/1948 | Bristow | 220/43 |
| 2,721,000 | 10/1955 | Schwendler et al. | 220/44 |
| 2,885,108 | 5/1959 | Donoghue | 220/698 |
| 2,894,844 | 7/1959 | Shakman | 426/395 |
| 2,915,404 | 12/1959 | Tessmer et al. | 99/171 |
| 3,023,927 | 3/1962 | Ehman | 220/66 |
| 3,077,409 | 2/1963 | Baselt | 99/152 |
| 3,105,765 | 10/1963 | Creegan | 426/118 |
| 3,302,822 | 2/1967 | Edwards | 220/366 X |
| 3,338,465 | 8/1967 | Bard | 220/66 |
| 3,380,624 | 4/1968 | Lincoln et al. | 220/93 |
| 3,433,386 | 3/1969 | Ehman | 426/131 |
| 3,704,140 | 11/1972 | Petit et al. | 426/131 |
| 3,797,694 | 3/1974 | See et al. | 220/44 R |
| 3,967,746 | 7/1976 | Botkin | 215/260 |
| 4,225,045 | 9/1980 | Rayner et al. | 206/508 |
| 4,318,494 | 3/1982 | Heyn | 220/271 |
| 4,399,159 | 8/1983 | Guibert | 426/113 |
| 4,541,544 | 9/1985 | Martin, Jr. et al. | 220/374 |
| 4,545,498 | 10/1985 | Schmid | 215/260 |
| 4,756,443 | 7/1988 | Murayama | 220/270 |
| 4,830,214 | 5/1989 | Curliss et al. | 220/270 |
| 4,902,521 | 2/1990 | Rosenfeld | 426/112 |
| 4,921,712 | 5/1990 | Malmquist | 426/77 |
| 4,928,845 | 5/1990 | Doyle | 220/271 |
| 4,966,780 | 10/1990 | Hargraves et al. | 426/118 |
| 4,990,345 | 2/1991 | Webb | 426/123 |
| 5,103,990 | 4/1992 | Irwin | 215/320 |
| 5,121,858 | 6/1992 | Chong | 222/397 |
| 5,344,662 | 9/1994 | Payne et al. | 426/124 |

FOREIGN PATENT DOCUMENTS

| | | |
|---|---|---|
| 1309992 | 11/1992 | Canada . |
| 0124579 | 5/1991 | Japan . |

OTHER PUBLICATIONS

Drawing Figure A.
Drawing Figure B.
Drawing Figure C.

*Primary Examiner*—Gary E. Elkins
*Attorney, Agent, or Firm*—D. L. Gakasek; M. E. Hilton

[57] ABSTRACT

The present invention provides a package such as a cylindrical can for containing a particulate product, such as roast and ground coffee, under pressure. The package automatically releases the pressure upon opening while preventing the escape of the particulate product. The package is made from a container having a closed top, a closed bottom, and an enclosed body between the top and the bottom. The package includes a venting member disposed within the container near the top. One end of the venting member abuts against the body of the container along its perimeter and another end abuts against the top of the container along its perimeter. The package further includes a channel between the venting member and the container. When the container is initially opened with a can opener, the top of the container is punctured in an area above the channel. The pressure is then released from the container into the channel and out of the package while the particulate product is prevented from escaping.

35 Claims, 8 Drawing Sheets

PRESSURIZED PACKAGE FOR A PARTICULATE MATERIAL EMPLOYING A VENTING MEMBER

This is a continuation of application Ser. No. 07/957,570, filed on Oct. 7, 1992, abandoned.

FIELD OF THE INVENTION

The present invention relates to packages for particulate material. The present invention has further relation to packaging such particulate material under pressure.

The present invention has further relation to such packaging of particulate material under pressure wherein the package prevents the uncontrolled emission of the particulate material from the package when the package is initially opened.

The present invention has further relation to such packaging wherein the package lends itself to normal can opener opening.

The present invention has even further relation to the packaging of roast and ground coffee as soon as possible after roasting and grinding without allowing for substantial off gassing.

BACKGROUND OF THE INVENTION

It is well known in the art that fresh roasted coffee gives off substantial amounts of carbon dioxide and other gases, particularly after roasting and grinding. In the past, after the roasting and grinding of the coffee, the roast and ground coffee is usually allowed to set for a period of time sufficient to allow substantial off gassing. The coffee is then placed into a package which is subjected to a vacuum packing operation. The vacuum packing process results in a low level of oxygen in the package head space which is beneficial as oxygen tends to stale the coffee product. Additionally, upon initial opening of the package an influx of air into the package results in an audible signal to the consumer that the product contained within it is fresh. A common package that is used to vacuum pack coffee is a cylindrical tin plated steel stock can. The can is easily opened with a common household can opener.

Recently, there has been a desire to package coffee immediately after roasting and grinding without substantial off gassing. Packaging of the coffee immediately after roasting and grinding provides substantial savings in the packaging of the coffee as the coffee does not need to sit in order to off gas. Furthermore, upon opening of a pressurized coffee package the consumer would receive a pleasurable burst of aroma of fresh ground coffee. This burst of aroma is much more noticeable in a pressurized coffee package than in a vacuum packed coffee package. The problem, however, with packaging particulate material, such as roast and ground coffee, under pressure is in containing the particulate material upon the initial opening of the package. For example if an ordinary coffee can was packed under pressure a significant amount of coffee material would begin to emit uncontrollably from the puncture in the can when it is initially opened with a can opener. This uncontrolled emission from the coffee can creates a considerable mess in the surrounding area that it was opened.

One package that is designed to contain particulate material, such as roast and ground coffee, while preventing the uncontrolled emission of coffee from the package upon opening is described in commonly assigned U.S. Pat. No. 4,966,780 issued to Hargraves et al. on Oct. 30, 1990. Hargraves discloses a semi rigid substantially gas impervious package for roast and ground coffee having a resealable closure. The package disclosed in this reference includes a means to prevent aspiration of the pressurized coffee from the discharge orifice of the container upon initial opening by the consumer. In a particularly preferred embodiment of the Hargraves package, the means comprises a porous filter member secured across either the discharge orifice or the resealable closure.

However, many consumers are so accustomed to the ordinary coffee can that they prefer it over other types of packages. Moreover, the ordinary coffee can provides for a significant cost savings over the Hargraves package. However, as stated above, when the typical coffee can is pressurized, the pressure causes the ground coffee to emit from the puncture in the can when it is opened using a normal can opener. There has, therefore, been a desire to provide a package for containing particulate material under pressure which is much like an ordinary coffee can and can be opened with common can opener, but which will prevent the uncontrolled emission of the coffee from the package upon initial opening.

It is, therefore, an object of the present invention to provide a package for containing particulate material under pressure but which will prevent the uncontrolled emission of particulate material upon initial opening.

It is another object of the present invention to provide such a package that can be opened with a common can opener.

It is another object of the present invention to provide such a package that appears to consumers to be an ordinary coffee can.

It is another object of the present invention to provide such a package for containing coffee to be packaged immediately after roasting and grinding and before substantial off gassing.

The aforementioned and other objects of the present invention will become more apparent hereinafter.

SUMMARY OF THE INVENTION

In accordance with the present invention there is provided a package for containing a particulate product under pressure. The package automatically releases the pressure upon opening while substantially preventing the escape of the particulate material during this opening process. The package comprises a container having a closed top, a closed bottom, and an enclosed body between the top and the bottom, which together define an interior chamber for containing the particulate product under pressure. The package further includes a venting member disposed within the container adjacent the top. The venting member has a first end and a second end. The first end is adjacent the body of the container and the venting member abuts against the body of the container along substantially its entire perimeter at a point adjacent the first end. The second end abuts against the top of the container along substantially its entire perimeter. The package further includes a channel defined by the venting member and that portion of the body of the container above the first end of the venting member. The venting member is so disposed within the container that when the container is initially opened with a can opener, the top of the container is punctured in an area superposed upon the channel. The pressure is thereby released from the container into the channel and out of the package while the particulate product is substantially prevented from escaping from the package.

BRIEF DESCRIPTION OF THE DRAWINGS

While the specification concludes with claims particularly pointing out and distinctly claiming the present invention, it is believed the present invention will be better understood from the following description taken in conjunction with the accompanying drawings in which.

DETAILED DESCRIPTION OF THE INVENTION

Figure 1:
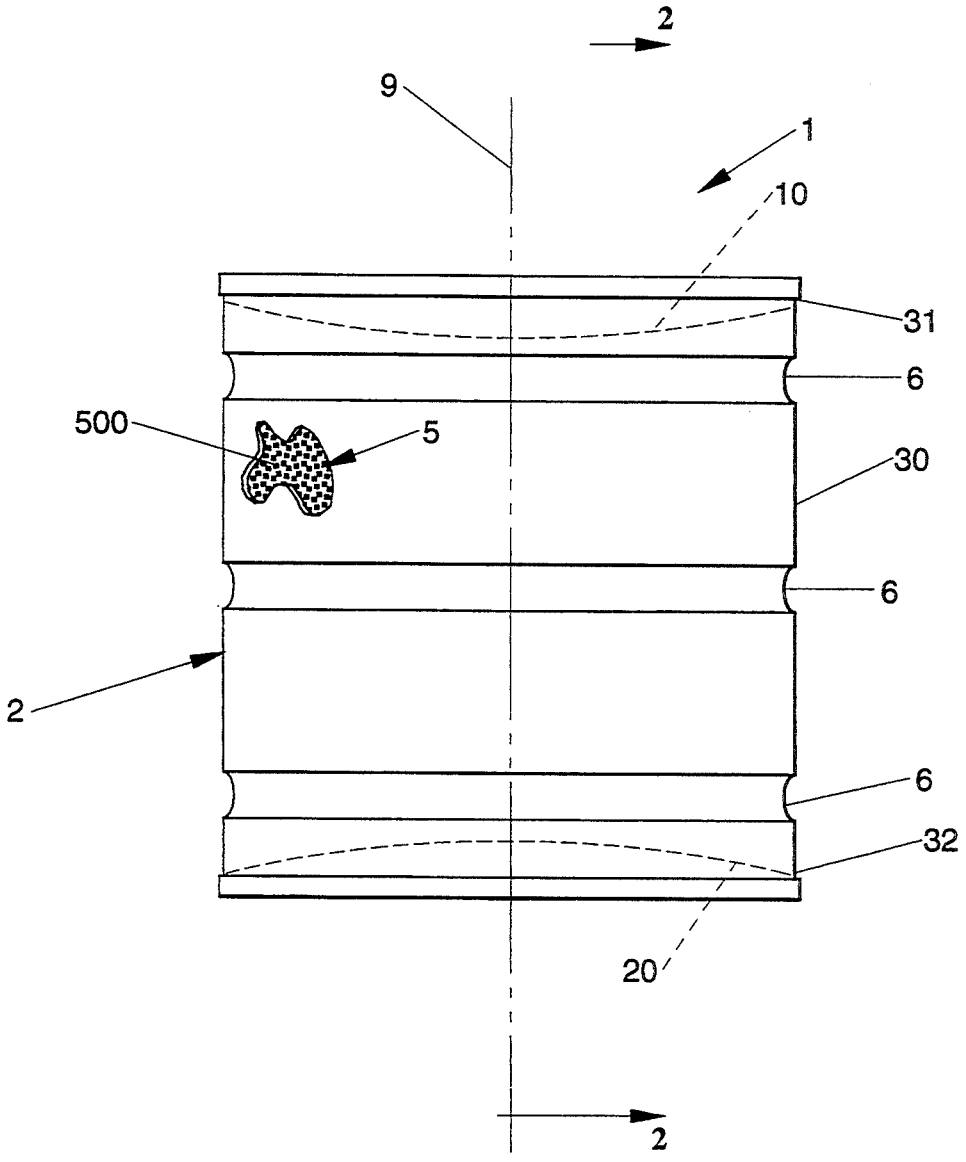
FIG. 1 is a plan view of the front of the package of the present invention.

Referring to the drawings in detail where in like numerals indicate the same elements throughout the views there is shown in FIG. 1, a plan view of a package 1 for containing a particulate product 500, such as roast and ground coffee, under pressure. Package 1 of the present invention can take any number of shape or forms and be made of any number of materials, FIG. 1 shows a preferred embodiment for the package wherein package 1 is a cylindrical can formed from tin plated steel stock. Package 1 will also be referred to as can 1, but it is not intended that the present invention be limited to such cans. Package 1 comprises a container 2, having a closed top 10, a closed bottom 20 and a body portion 30. The top 10 is secured to top 31 of body 30, and the bottom 20 is secured to the bottom 32 of body 30. Container 2 has an interior chamber 5 for containing a particulate product 500 under pressure. Container 2 also includes inwardly deflected ribs 6 for decoration.

It is preferred that the top 10 and bottom 20 be disposed concave inwardly towards the chamber 5 so that undesirable deflections of the top 20 and bottom 30 are minimized due to the internal pressure of can 1. If the bottom end expands out too much so that it concaves outwardly, the can 1 will develop what is referred to as a rocker bottom. That is if bottom 20 deflects outwardly so much the package 1 will not be stable while resting on a flat surface but will tend to rock back and forth. If the top end 10 deflects outwardly too much multiple cans will not be stackable on top of one another on a store shelf or the like.

Figure 2:
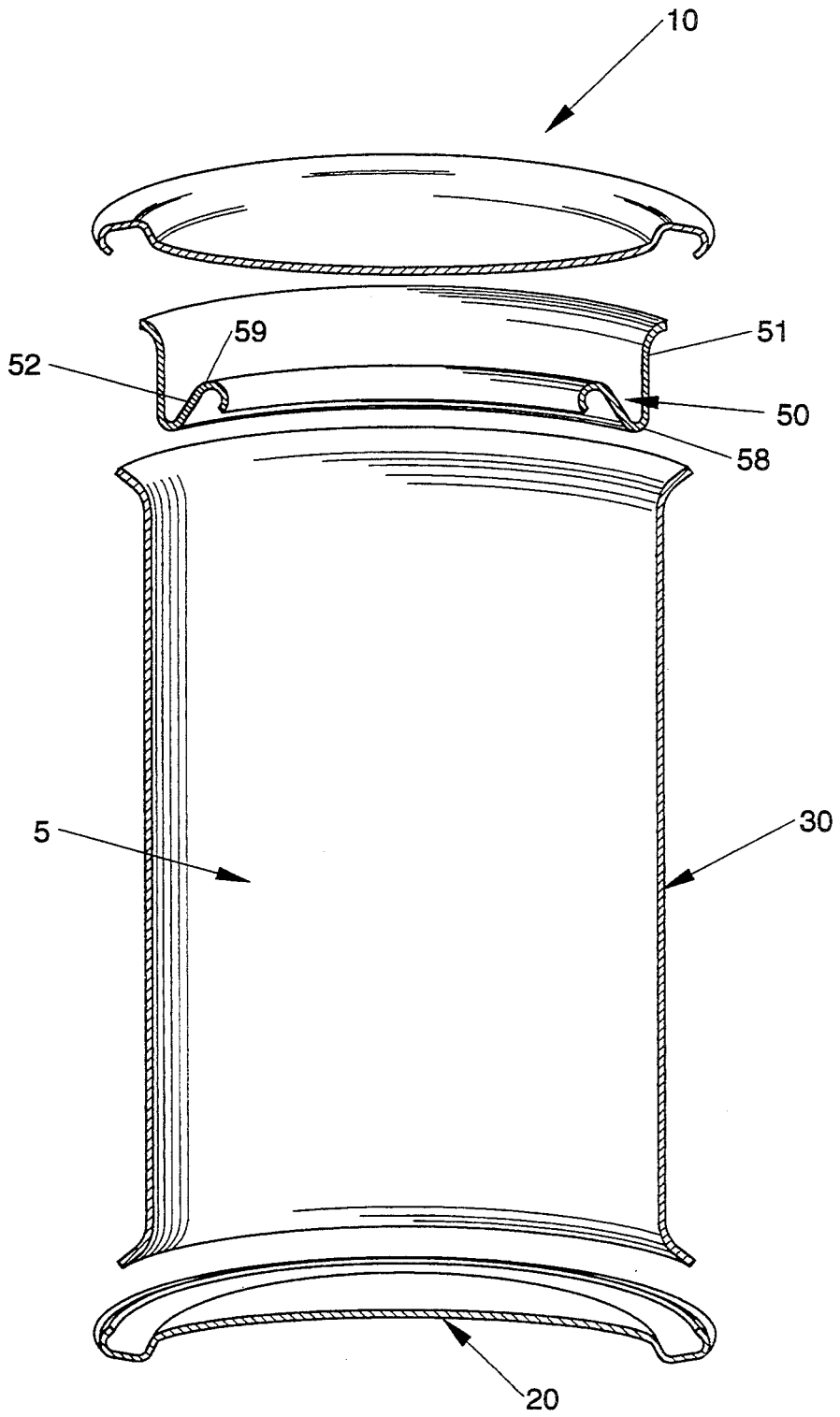
FIG. 2 is an exploded perspective cross-sectional view of the package of the present invention taken along lines 2—2 of FIG. 1.

It is believed that the invention can be better understood by referring to FIG. 2 where there is shown an exploded perspective cross-sectional view of FIG. 1 taken along line 2—2. As can be seen from FIG. 2, package 1 further includes a venting member 50 that is disposed within container 2 substantially along its entire perimeter adjacent top 10. Venting member 50 has a a first end 58 and a second end 59. The first end 58 is adjacent the body 30 of container 2 and the venting member 50 abuts against the body 30 of container 2 along substantially its entire perimeter at a point adjacent end 58. The second end 59 abuts against the top 10 of container 2 along substantially its entire perimeter. The container further includes a channel 52 defined by venting member 50 and that portion 38 of body 30 above the first end 59 of venting member 50. In a preferred embodiment channel 52 is substantially void of particulate product prior to opening.

In a preferred embodiment that is shown in the Figures, venting member 50 includes a leg 51 extending from the first end 58. As seen from FIG. 4, when the package 1 is assembled the leg 51 abuts against body 30 of container 2 along substantially its entire perimeter adjacent the top 10, and the second end 59 of venting member 50 abuts against the top 10 of package 1 along substantially its entire perimeter. However, leg 51 is not absolutely necessary. End 58 could be directly secured to the body of the container or the package could have a means for abutting end 58 against body 30 along substantially its entire perimeter.

In a preferred embodiment venting member 50 comprises a ring having a substantially U-shaped cross-section when taken parallel to the packages vertical axis 9. Venting member 50 can be formed from any number of materials including aluminum or plastic. In a preferred embodiment member 50 is made from tin plated steel stock. The shaping of the channel 50 can be accomplished by any number of methods commonly known in the art including the use of a stamping operation using a mating die set.

Package 1 can be assembled in any order using any number of methods. There are, however, some preferred embodiments for attaching the venting member 50 to the container 2. As mentioned above end 58 could be directly secured to the body of the container by welding, adhesives or any other means, or as described in further below the package could have a bead or any other means for abutting end 58 against body 30 along substantially its entire perimeter.

Figure 3:
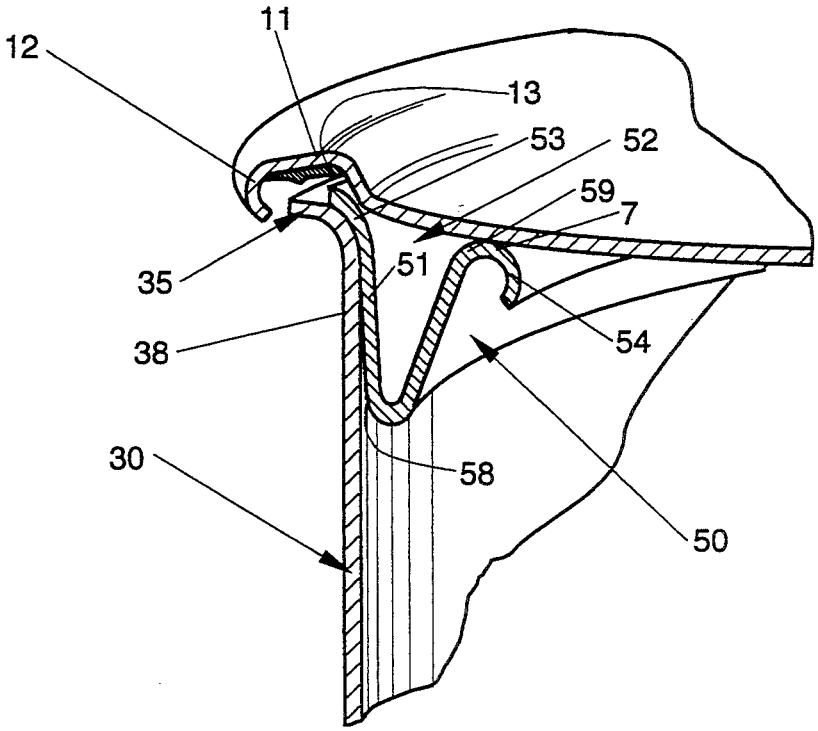
FIG. 3 is a partial perspective view of a cross-section of the package of the present invention before top 10 is seamed to the body 30.

One embodiment for attaching member 50 to container 2 is shown in FIG. 3. As seen from this Figure, leg 51 of venting member 50 has an outwardly directed flange 53 projecting therefrom. Flange 53 is seated on an outwardly directed flange 35 of container body 30. It is preferred that the radius of curvature of flange 53 equal that of flange 35, and that the diameter of the venting member 50 be only slightly smaller than the diameter of the body 30 so that venting member 50 fits tightly within the body 30. This is so that the member 50 does not come loose before the top 10 is seamed onto the body 30.

After the venting member 50 is fitted within body 30, the top 10 is placed onto the body 30. Top 10 has a lip 11 along its outer perimeter. Lip 11 has a downwardly and inwardly directed flange 12 along its perimeter. Lip 11 further has a sealing compound 13 applied to its underside to help ensure the air-tightness of the can. Such sealing compounds are generally known in the art and include Polyterpene/estergum. Top 10 is placed onto the body 30 of container 2 so that flange 53 is pinched in between lip 11 and flange 35 of body 30. The top 10 is then seamed onto body 30 using any number of mechanical operations known in the art. The bottom 20 is seamed to the container 2 in a similar way, but without the venting channel 50.

Figure 4:
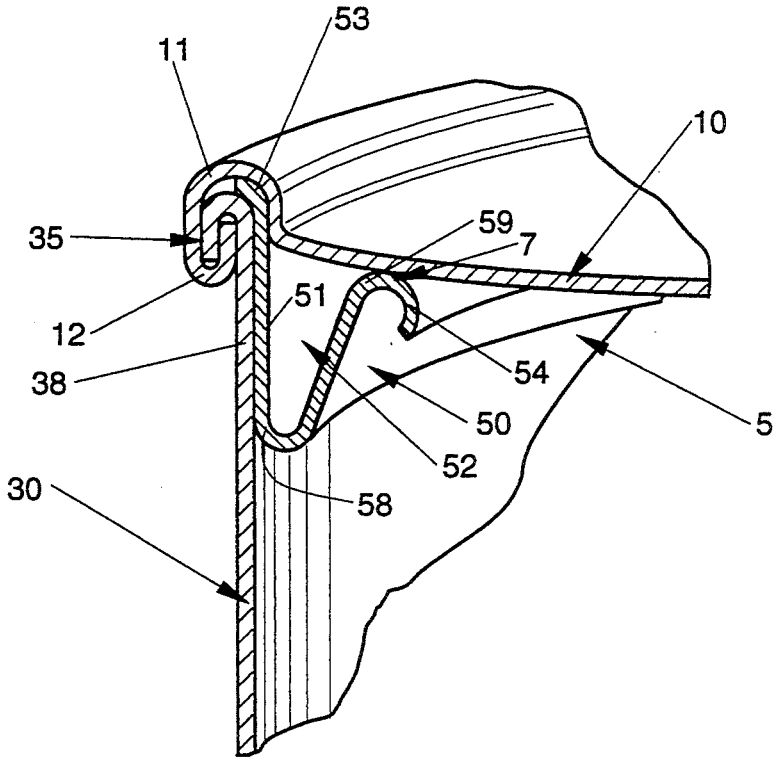
FIG. 4 is a view similar to FIG. 3 showing the top 10 seamed onto the body 30.

The package 1 now appears as it does in FIG. 4. As seen in FIG. 4, flange 12 of lip 11 curls back under flange 35 creating what is referred to in the art as a double seam. In order to obtain a better seal it is preferred that flange 53 be shorter than flange 35, as shown in the Figures. This is so flange 53 does not interfere with the seal between lip 11, flange 12, sealing compound 13 and flange 35. However, this is not absolutely necessary, and flange 53 could extend outwardly to be substantially the same length as flange 35. Then after seaming flange 11 is pinched between lip 11 flange 12 and flange 35 along the entire double seam.

After seaming, end 59 of member 50 abuts against the top 10 of package 1 to form an interference seal 7. End 58 has a downwardly directed rounded flange 54 extending therefrom. Rounded flange 54 is there so that after opening, the member 50 presents no sharp edges to the consumer.

Figure 5:
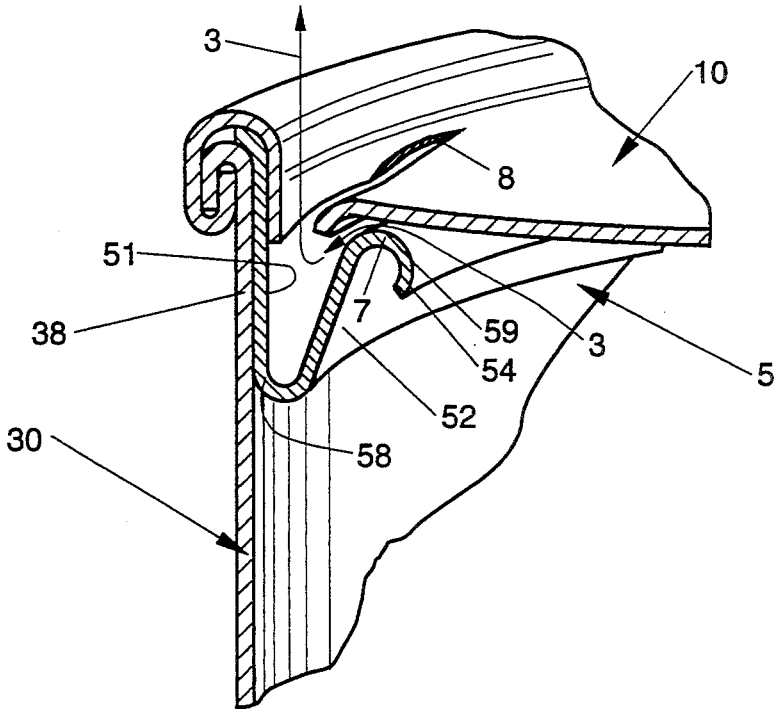
FIG. 5 is a view similar to that of FIG. 4 but showing the package after it has been initially opened.

How the venting member 50 keeps the particulate material from uncontrollably emitting from the can upon initial opening can best be described by referring to FIG. 5. As stated earlier package 1 is designed to be opened with an ordinary can opener. FIG. 5 shows the package 1 immediately after a can opener has created an initial puncture 8 in the package along the outer perimeter of the top 10. The venting member 50 is disposed within the container 30 such that when the package is initially opened with a can opener, the top 10 of the container 2 is punctured in an area superposed upon channel 52.

Upon initial opening of package 1, the pressure in chamber 5 goes around interference seal 7 into channel 52 and out through puncture 8 as noted by air flow lines 3, while the particulate product is substantially prevented from escaping from the package 1. Interference seal 7 should be strong enough such that upon initial opening of the package the gas in the package will escape around flange 54 and end 59 while preventing the escape of particulate material through puncture 8. It is believed that if interference seal 7 is strong enough it will allow the gas to escape while preventing the escape of particulate material through the puncture 8 because the venting member 50 makes the particulate material travel a torturous path to the puncture. The torturous path around the end 59 and into channel 52 blocks and slows down most of the particulate material travelling with the escaping gas. If the interference seal is strong enough for a given pressure, it is believed that most of the particulate material will be blocked or will slow down enough so that only a minimal amount of particulate material is allowed to escape. If interference seal 7 is too weak too much particulate material will escape through the puncture 8. It is necessary during the seaming operation that the top 10 does not deflect member 50 along interference seal 7 so much that member 50 is permanently deformed downwardly adjacent end 59, thereby creating a weak seal or none at all.

Figure 6:
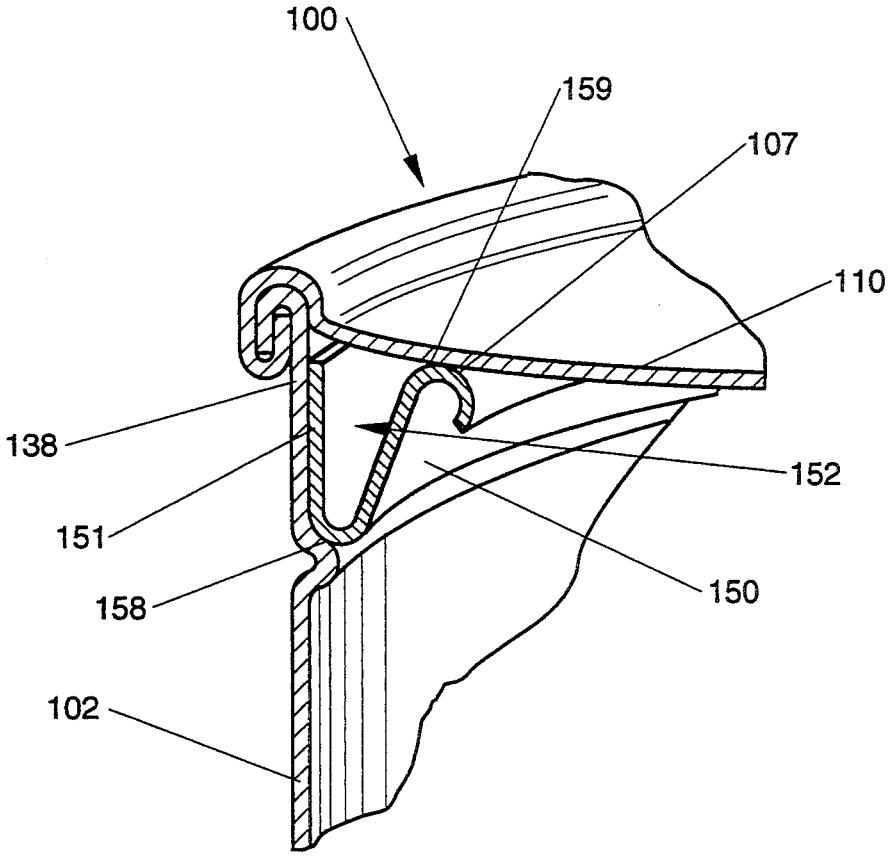
FIG. 6 is a partial perspective view of a cross-section of an alternative embodiment of the package of the present invention.

An alternative embodiment for placing the venting member within the container is shown in FIG. 6. FIG. 6 is a partial cross-sectional view of a package 100 which is similar in structure in package 1. FIG. 6 shows package 100 comprising container 102 having a body 130 and a closed top 110. Container 102 includes an inwardly directed bead 106 adjacent top 110. Package 100 has venting member 150 disposed within container 102 substantially along its entire perimeter adjacent top 110. Venting member 150 has a first end 158 and a second end 159. The first end 158 is seated on and abuts against bead 106 along substantially its entire perimeter, and the second end 159 abuts against the top 110 of container 102 along substantially its entire perimeter. The container further includes a channel 152 defined by venting member 150 and that portion 138 of body 130 above the first end 159 of venting member 150. Bead 106 is a means for abutting venting member 150 against body 130 of container 102.

In the preferred embodiment shown in FIG. 6 venting member 150 further includes leg 151 extending from end 158. Leg 151 abuts against body 130 of container 102 along substantially its entire perimeter adjacent the top 110 in order to help better secure member 150 within the container 102. Instead of leg 151 being seamed between the top 110 and body 130 during the seaming operation, the ring is kept in place by the bead 106 and the interference seal 107 between end 159 and top 110. This eliminates any potential interference of leg 151 with the packages double seam.

Figure 7:
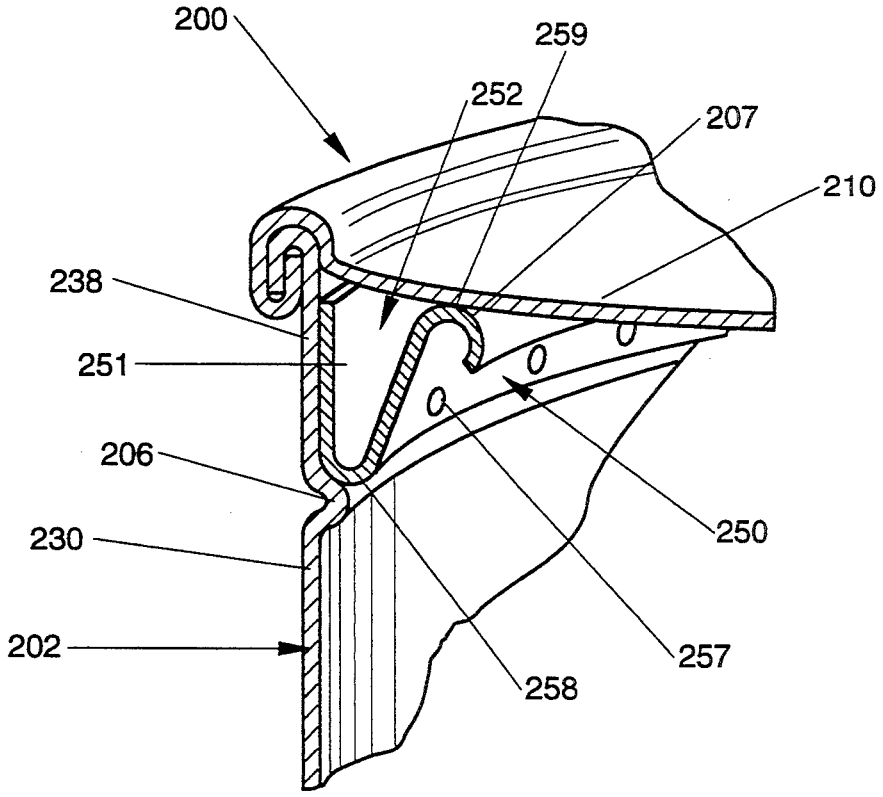
FIG. 7 is a partial perspective view of a cross-section of yet another alternative embodiment of the package of the present invention.

Yet another alternative embodiment for the package of the present invention is shown in FIG. 7. FIG. 7 is a partial cross-sectional view of a package 200 which is similar in structure in package 100. FIG. 7 shows package 200 comprising container 202 having a body 230 and a closed top 210. Container 202 includes an inwardly directed bead 206 adjacent, top 210. Package 200 has venting member 250 disposed within container 202 substantially along its entire perimeter adjacent top 210. Venting member 250 has a first end 258 and a second end 259. The first end 258 is seated on and abuts against bead 206 along substantially its entire perimeter, and the second end 259 abuts against the top 210 of container 202 along substantially its entire perimeter. The container further includes a channel 252 defined by venting member 250 and that portion 238 of body 230 above the first end 259 of venting member 250. Bead 206 is a means for abutting venting member 250 against body 230 of container 202. In the preferred embodiment shown in FIG. 7 venting member 250 further includes leg 251 extending from end 258. Leg 251 abuts against body 230 of container 202 along substantially its entire perimeter adjacent the top 210 in order to help better secure member 250 within the container 202.

Figure 8:
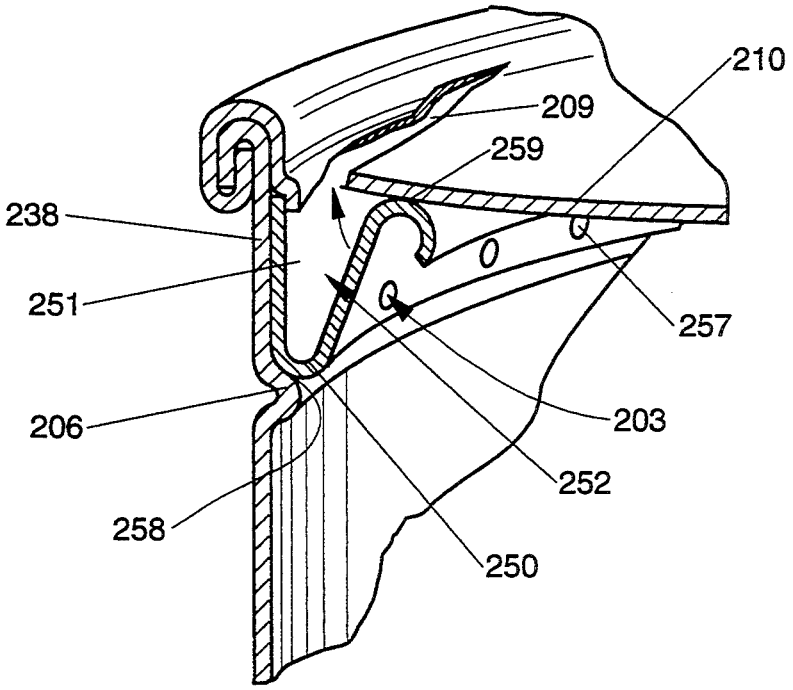
FIG. 8 is a view similar to that of FIG. 7 but showing the package after it has been initially opened.

The difference between package 100 and package 200 is that venting member 250 has a plurality of apertures 257 disposed along its perimeter. Apertures 257 can be placed on the ring by any suitable means known in the art including laser drilling, photo-etching and mechanical puncturing. The reason for apertures 257 can best be explained by referring to FIG. 8. FIG. 8 is a similar figure to that of FIG. 7 but showing the package immediately after a can opener has punctured the package. As seen from the figure pressure not only escapes around interference seal 207 but also through apertures 257 and into channel 252 and out of the package 201. In a preferred embodiment substantially all of the pressure would escape through the apertures 257 and interference seal 207 would remain somewhat intact, letting very little gas through. To better prevent particulate material from escaping it is preferred that the size of the apertures be smaller than the average particle size of the particulate material.

In an alternative embodiment to having the apertures in the venting member, either the second end of the venting member, the top of the container, or both could have a plurality of ridges or protrusions disposed along the interference seal that create a plurality of apertures within the interference seal. In this embodiment instead of pressure escaping through the apertures in the venting member it escapes around the interference seal by passing through the apertures created by the ridges.

In one embodiment of the package, once the package of the present invention is opened it is preferred that the venting channel remain secured within the container so that the consumer does not have any additional components to dispose of prior to finishing the contents of the package. For package 1, because the ring is seamed onto the container it will remain in place after opening. However, for packages 100 and 200 this is not case and they will need to be provided with a means for securing the venting member within the container. As seen from FIG. 8 if leg 251 of package 200 or leg 151 of package 100 is made long enough, the cut away portion of the can will press against the legs and keep the venting channel intact. Alternatively, venting channels 150 and 250 could be secured to the container by any suitable method including adhesives and welding.

In another embodiment of the package it is desired that the second leg of the securing ring be intermittently secured to the top of the container. This is so that when the package is opened, the venting channel is removed and thrown away with the cut away portion of the top. The second leg can be intermittently secured to the top of the container by any number means known in the art. If the venting channel has a plurality of apertures disposed therein, the venting channel could be secured to the top of the container substantially continuously.

While particular embodiments of the present invention have been illustrated and described, various modifications will be apparent to those skilled in the art without departing from the spirit and scope of the present invention. Accordingly, the scope of the present invention should be considered in terms of the following claims and is understood not to be limited to the details described and shown in the specification and drawings.

What is claimed is:

1. A package containing a particulate product under pressure, said package automatically releasing said pressure upon opening while substantially preventing the escape of said particulate product, said package comprising:

a) a container having a closed top, a closed bottom and a body having an enclosed perimeter between said top and said bottom, said body, said top and said bottom together define an interior chamber, said interior chamber containing a particulate product under pressure; and b) a venting member disposed within said container substantially continuously along said body's entire perimeter adjacent said top, said member having first and second ends, said first end abutting against said body of said container along substantially its entire perimeter, said second end abutting substantially continuously against said top of said container, said venting member defining a channel above said venting member, adjacent said top of said package, said venting member disposed within said container such that said particulate product is substantially prevented from entering said channel prior to initial opening of said package, said venting member being so disposed within said container that when said package is initially opened with a can opener, said top is punctured in an area superposed upon said channel, whereby pressure is released from said container into said channel and out of said package while said particulate product is substantially prevented from escaping from said package.

2. The package according to claim 1 wherein said top and said bottom of said container are disposed concave inwardly.

3. The package according to claim 1 wherein said venting member has a leg extending from said first end, said leg abutting against said body of said container along substantially its entire perimeter adjacent said top.

4. The package according to claim 3 wherein said venting member includes an outwardly directed flange projecting from said leg, said flange being pinched between said body and said top of said package whereby upon opening of said package said venting channel remains secured within said container.

5. The package according to claim 4 wherein said second end of said venting member has a downwardly directed rounded flange extending therefrom.

6. The package according to claim 1 wherein said body of said container includes an inwardly directed bead adjacent said top, said first end of said venting member abuts against said bead thereby securing said member within said container prior to opening.

7. The package according to claim 1 wherein said container and said venting member are formed from tin plated steel stock.

8. The package according to claim 1 wherein said second end of said venting member is intermittently secured to said top of said container, whereby when said package is opened said venting member is removed with the cut away portion of said top of said package.

9. The package according to claim 1 further including a means for securing said venting member within said container after opening.

10. The package according to claim 1 wherein said body of said package is generally cylindrical and said top and said bottom are generally circular and wherein said venting member comprises a ring having a substantially U-shaped cross-section when taken perpendicular to said packages longitudinal axis running from said top to said bottom, said ring disposed within said chamber with the open end of the U facing towards said top.

11. The package according to claim 1 wherein said channel is substantially void of said particulate material prior to opening.

12. A package for containing a particulate product under pressure, said package automatically releasing said pressure upon opening while substantially preventing the escape of said particulate product, said package comprising:

a) a container having a closed top, a closed bottom and a body having an enclosed perimeter between said top and said bottom, said body, said top and said bottom together define an interior chamber, said interior chamber for containing said particulate product under pressure; and b) a venting member disposed within said container substantially continuously along said body's entire perimeter adjacent said top, said venting member having a plurality of apertures disposed therein, said member having first and second ends, said first end abutting against said body of said container along substantially its entire perimeter, said second end abutting substantially continuously against said top of said container, said venting member defining a channel above said venting member, adjacent said top of said package, said venting member being so disposed within said container that when said package is initially opened with a can opener, said top is punctured in an area superposed upon said channel, whereby pressure is released from said container into said channel and out of said package while said particulate product is substantially prevented from escaping from said package.

13. The package according to claim 12 wherein said top and said bottom of said container are disposed concave inwardly.

14. The package according to claim 12 wherein said venting member has a leg extending from said first end, said leg abutting against said body of said container along substantially its entire perimeter adjacent said top.

15. The package according to claim 14 wherein said venting member includes an outwardly directed flange projecting from said leg, said flange being pinched in between the top of said body and said top of said package whereby upon opening of said package said venting channel remains secured within said container.

16. The package according to claim 12 wherein said second end of said venting member has a downwardly directed rounded flange extending therefrom.

17. The package according to claim 12 wherein said body of said container includes an inwardly directed bead adjacent said top, said first end of said venting member abuts against said bead, thereby securing said member within said container prior to opening.

18. The package according to claim 12 wherein said container and said venting member are formed from tin plated steel stock.

19. The package according to claim 12 wherein said second end of said venting member is intermittently secured to said top of said container, whereby when said package is opened said venting member is removed with the cut away portion of said top of said package.

20. The package according to claim 12 further including a means for securing said venting member within said container after opening.

21. The package according to claim 12 wherein said body of said package is generally cylindrical and said top and said bottom are generally circular and wherein said venting member comprises a ring having a substantially U-shaped cross-section when taken perpendicular to said packages longitudinal axis running from said top to said bottom, said ring disposed within said chamber with the open end of the U facing towards said top.

22. The package according to claim 12 wherein said package is filled with particulate product and said apertures in said venting member are smaller than the average particle size of said particulate product.

23. The package according to claim 12 wherein said second end of said venting member abuts against said top of said package so as to form an interference seal having sufficient strength so that when said package is initially opened substantially all of said pressure escapes through said apertures and into said channel.

24. The package according to claim 23 wherein said second end of said venting channel is substantially continuously secured to said top of said container.

25. The package according to claim 12 wherein said channel is substantially void of said particulate product prior to opening.

26. A can containing roast and ground coffee under pressure, said can being able to release said pressure upon opening while substantially preventing the escape of said particulate product, said can comprising:

a) a generally cylindrical container formed from tin plated steel stock, said container having a closed top, a closed bottom and a body having an enclosed perimeter between said top and said bottom, said body, said top and said bottom together define an interior chamber containing said roast and ground coffee under pressure, said top and said bottom being disposed concaved inwardly towards said chamber; and b) a venting member disposed within said container substantially continuously along said body's entire perimeter adjacent said top, said member having first and second ends, said first end adjacent said body said body of said container, said second end abutting substantially continuously against said top of said container, said venting member having leg extending from said first end, said leg abutting against said body of said container along substantially its entire perimeter adjacent said top, said venting member defining a channel above said venting member, adjacent said top of said package, said venting member disposed within said container such that said roast and ground coffee is substantially prevented from entering said channel prior to opening, said channel being substantially void of said particulate product prior to opening, said venting member being so disposed within said container that when said container is initially opened with a can opener, said top is punctured in an area superposed upon said channel, whereby pressure is released from said container into said channel and out of said package while said particulate product is substantially prevented from escaping from said package.

27. The can of claim 26 wherein said venting channel has a plurality of apertures disposed therein.

28. The can of claim 27 wherein said package is filled with particulate product and said apertures are smaller than the average particle size of said roast and ground coffee.

29. The can according to claim 26 wherein said second end of said venting member has a downwardly directed rounded flange extending therefrom.

30. The can according to claim 26 wherein said body of said container includes an inwardly directed bead adjacent said top, said first end of said venting member abutting against said bead, said bead thereby securing said member within said container adjacent said top prior to opening.

31. The can according to claim 26 wherein said second end of said venting member is intermittently secured to said top of said container, whereby when said package is opened said venting member is removed with the cut away portion of said top of said package.

32. The can according to claim 26 further including a means for securing said venting member within said container after opening.

33. The can according to claim 27 wherein said second end of said venting member abuts against said top of said package so as to form an interference seal having sufficient strength so that when said package is initially opened substantially all of said pressure escapes through said apertures and into said channel.

34. The can according to claim 33 wherein said second end of said venting channel is substantially continuously secured to said top of said container.

35. A package for containing a particulate product under pressure, said package automatically releasing said pressure upon opening while substantially preventing the escape of said particulate product, said package comprising:

a) a container having a closed top, a closed bottom and a body having an enclosed perimeter between said top and said bottom, said body, said top and said bottom together define an interior chamber, said interior chamber containing a particulate product under pressure, said top being disposed concave inwardly; and b) a venting member disposed within said container substantially continuously along said body's entire perimeter adjacent said top, said member having first and second ends, said first end abutting against said body of said container along substantially its entire perimeter, said second end abutting substantially continuously against said inwardly concave top of said container, said venting member defining a channel above said venting member, adjacent said top of said package, said venting member so disposed within said container that when said package is initially opened with a can opener, said top is punctured in an area superposed upon said channel, whereby pressure is released from said container into said channel and out of said package while said particulate product is substantially prevented from escaping from said package.

* * * * *

UNITED STATES PATENT AND TRADEMARK OFFICE

CERTIFICATE OF CORRECTION

PATENT NO. : 5,445,291

DATED : August 29, 1995

INVENTOR(S) : WADE K. DANIEL

It is certified that error appears in the above-identified patent and that said Letters Patent is hereby corrected as shown below:

On the Title page, item [56] References cited, please add:

3,240,383 3/1966 Scholtz.....220/44 --.

On the Title page, item [75] Inventor: "Gakasek" should read -- Garner --

Signed and Sealed this

Fifth Day of August, 1997

Bruce Lehman

*Attest:*

BRUCE LEHMAN

*Attesting Officer*

*Commissioner of Patents and Trademarks*